US007368878B1

(12) United States Patent
Lin et al.

(10) Patent No.: US 7,368,878 B1
(45) Date of Patent: May 6, 2008

(54) CURRENT-MODE RESONANT BALLAST

(75) Inventors: Jea-Sen Lin, Taipei County (TW); Ta-yung Yang, Milpitas (TW)

(73) Assignee: System General Corp., Taipei Hsien (TW)

( * ) Notice: Subject to any disclaimer, the term of this patent is extended or adjusted under 35 U.S.C. 154(b) by 63 days.

(21) Appl. No.: 11/535,988

(22) Filed: Sep. 28, 2006

(51) Int. Cl.
*H05B 37/00* (2006.01)

(52) U.S. Cl. ..... 315/209 R; 315/224; 315/DIG. 5; 315/DIG. 7

(58) Field of Classification Search ..... 315/209 R, 315/224, DIG. 5, DIG. 7
See application file for complete search history.

(56) References Cited

U.S. PATENT DOCUMENTS 5,449,979 A * 9/1995 Ueoka et al. ..... 315/225
5,977,725 A * 11/1999 Miyazaki et al. ..... 315/209 R

* cited by examiner

*Primary Examiner*—David H. Vu
(74) *Attorney, Agent, or Firm*—Jianq Chyun IP Office

(57) ABSTRACT

A lower-cost ballast circuit for fluorescent lamps is provided. A resonant circuit is formed by a series connection of an inductor and a capacitor to operate the fluorescent lamp. A first circuit and a second circuit are coupled to switch the resonant circuit. Taking the first circuit for instance, a first resistor is connected in series with a first switch for generating a first control signal in response to a switching current of the first switch. The first switch is turned on once the first control signal is lower than a first zero-threshold. After a quarter resonant period of the resonant circuit, the first switch is turned off once the first control signal is lower than a first threshold. Therefore, a soft switching for the first switch is achieved.

15 Claims, 5 Drawing Sheets

CURRENT-MODE RESONANT BALLAST

BACKGROUND OF THE INVENITON

1. Field of the Invention

The present invention relates in general to a ballast, and more particularly, to a ballast of fluorescent lamp.

2. Description of Related Art

Fluorescent lamps are one of the most popular light sources in our daily lives. Improving the efficiency of fluorescent lamps will significantly save energy. Therefore, in recent development, the improvement of efficiency and power savings for the ballast of the fluorescent lamp are the major concerns. FIG. 1 shows a conventional electronic ballast with a series resonant circuit. A half-bridge inverter consists of two switches 10 and 20. The two switches 10, 20 are complementarily switched on and off with 50% duty cycle at a desired switching frequency. The resonant circuit is composed of an inductor 70, a capacitor 80, and a fluorescent lamp 50. The fluorescent lamp 50 is in parallel connection with a capacitor 55. The capacitor 55 is operated as a start-up circuit. Once the fluorescent lamp 50 has been turned on, the switching frequency is controlled to produce the required lamp voltage. The drawback of the start-up circuit is higher switching losses caused by the switches 10 and 20. The parasitic devices of the fluorescent lamp, such as the equivalent capacitance, etc., are changed in response to the temperature variation and the age of the lamp. Besides, the inductance of the inductor 70 and the capacitance of the capacitor 80 are varied during mass production of the ballast.

SUMMARY OF THE INVENTION

The present invention provides a ballast circuit for fluorescent lamp. The lamp is connected in series with an inductor and a capacitor for forming a resonant circuit. A first circuit and a second circuit are coupled to the resonant circuit for switching the resonant circuit. Taking the first circuit for instance here, a first resistor is connected in series with a first switch for generating a first control signal in response to a switching current of the first switch. The first switch is turned on once the first control signal is lower than a first zero-threshold. After a quarter resonant period of the resonant circuit, the first switch is turned off once the first control signal is lower than a first threshold. Therefore, a soft switching for the first switch is achieved. The second circuit operates in a similar way to the first circuit to achieve the soft switching for a second switch.

An objective of the present invention is to provide a ballast that can automatically achieve soft switching for reducing switching loss and for improving efficiency.

It is another objective of the present invention to develop a lower cost circuit with higher performance in efficiency.

BRIEF DESCRIPTION OF ACCOMPANIED DRAWINGS

The accompanying drawings are included to provide a further understanding of the present invention, and are incorporated in and constitute a part of this specification. The drawings illustrate embodiments of the present invention and, together with the description, serve to explain the principles of the present invention.

FIG. 3~FIG. 6 respectively shows the first operation phase to the fourth operation phase of the ballast circuit according to an embodiment of the present invention.

Figure 7:
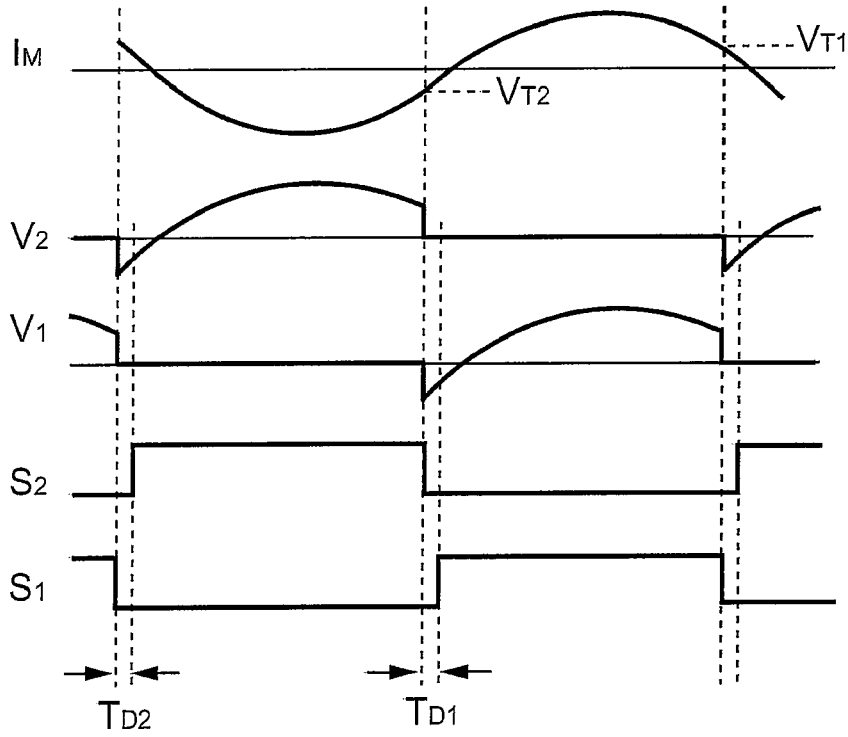

FIG. 7 shows a plurality of waveforms of the ballast circuit according to the present invention.

Figure 8:
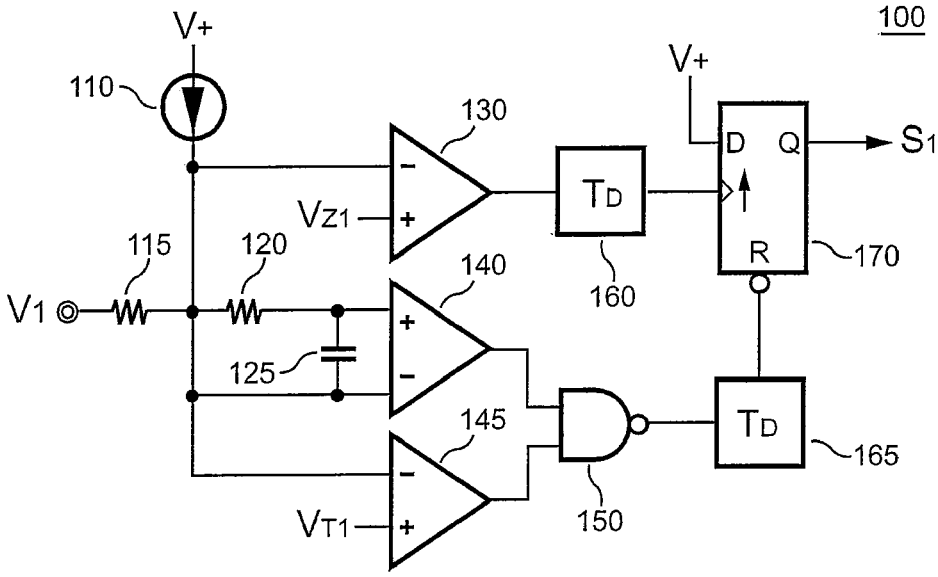

FIG. 8 shows a first control circuit of the ballast circuit according to a preferred embodiment of the present invention.

Figure 9:
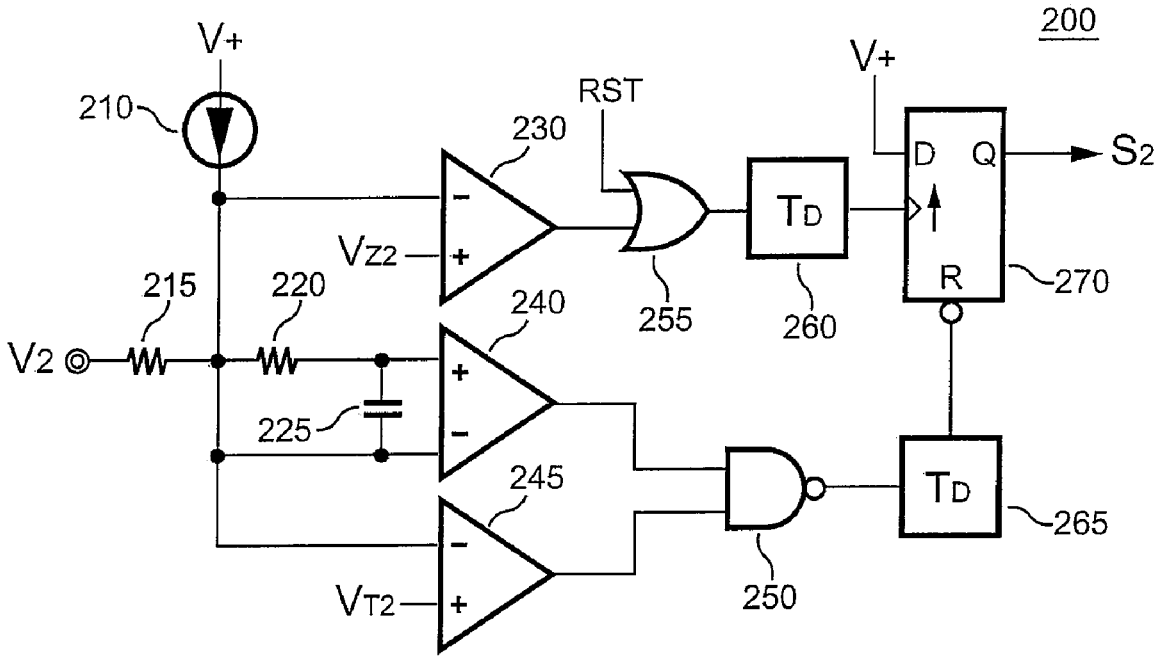

FIG. 9 shows a second control circuit of the ballast circuit according to a preferred embodiment of the present invention.

Figure 10:
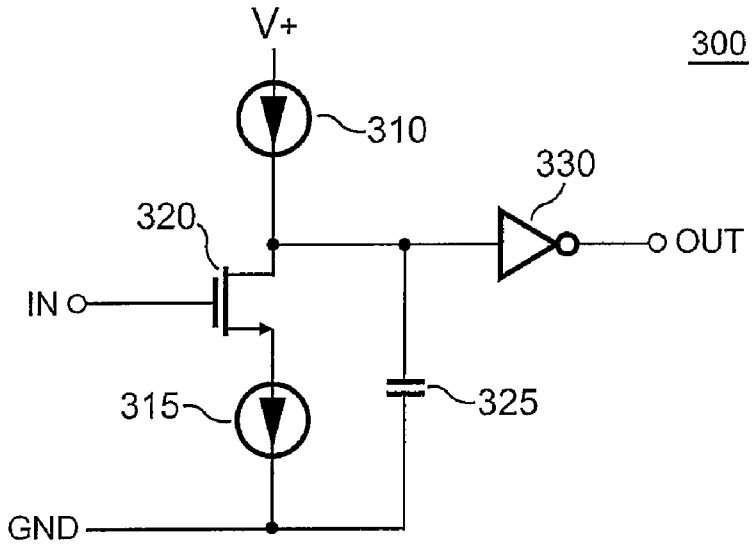

FIG. 10 shows a debounce circuit according to a preferred embodiment of the present invention.

DESCRIPTION OF THE PREFERRED EMBODIMENT

Figure 1:
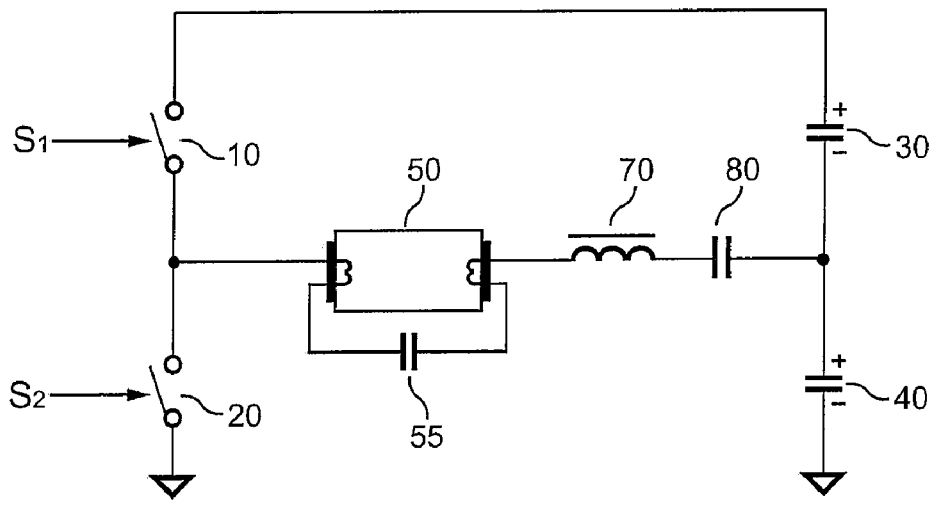
FIG. 1 (Prior Art)
FIG. 1 shows a conventional electronic ballast circuit.
Figure 2:
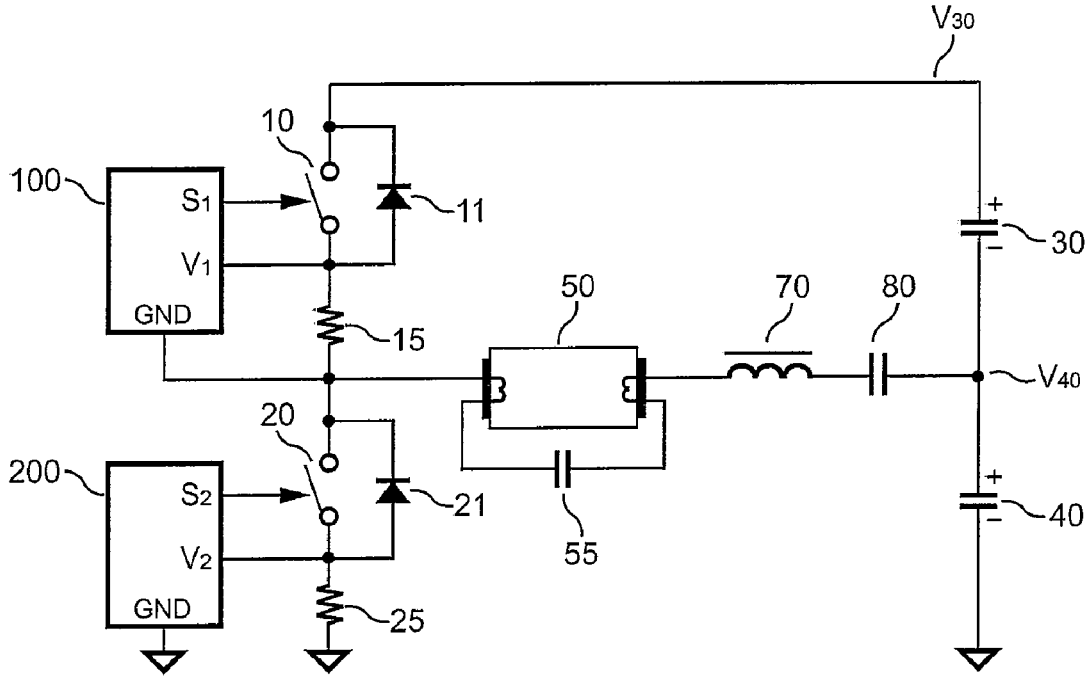
FIG. 2 is a schematic of a ballast circuit according to an embodiment of the present invention.
Figure 3:
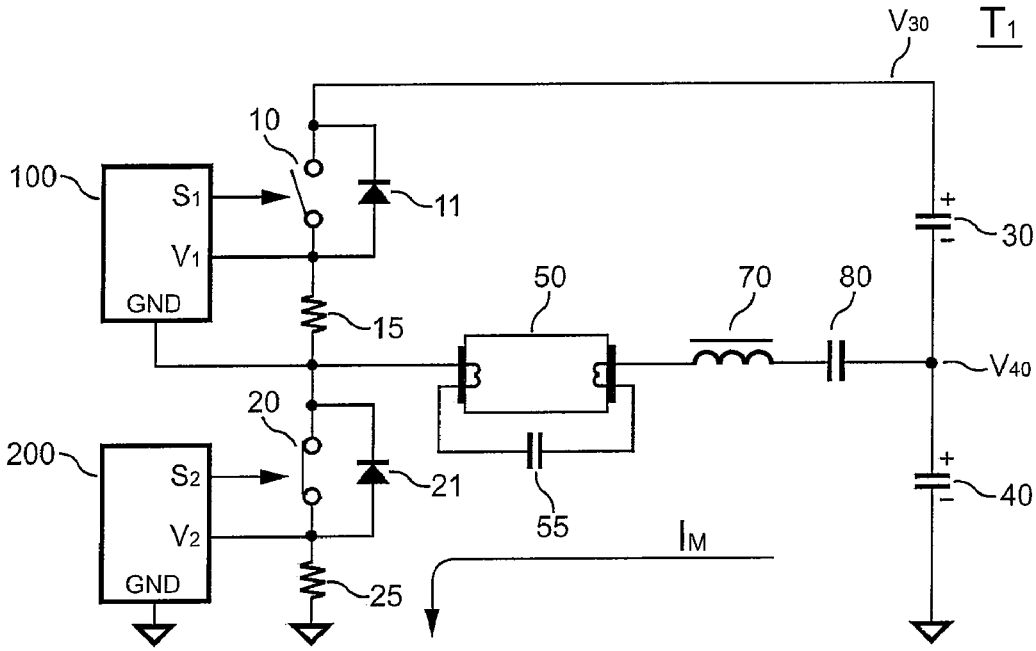
Figure 4:
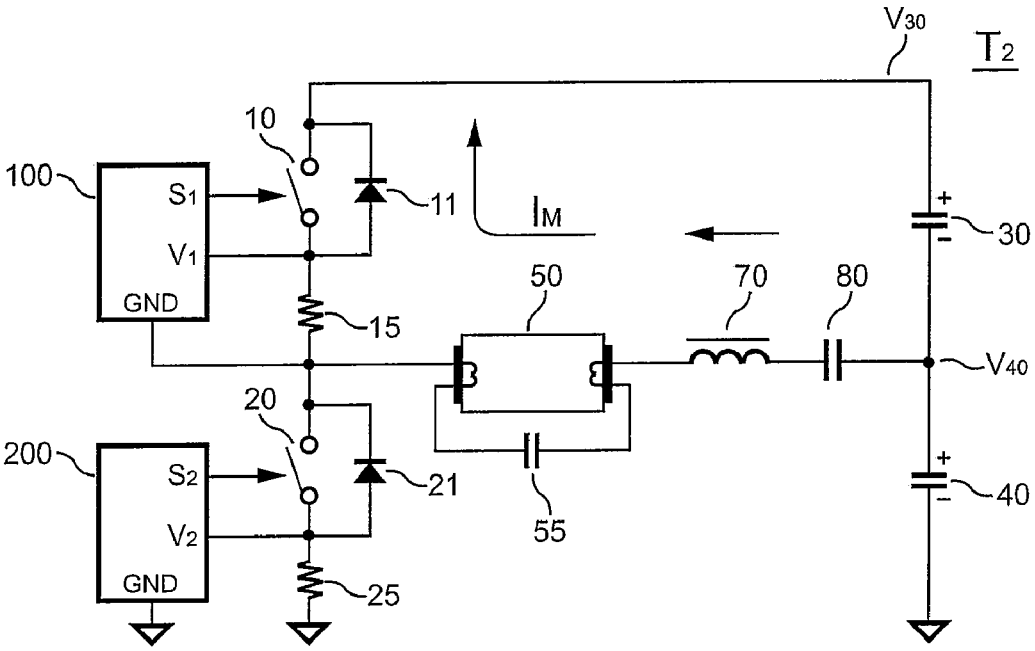
Figure 5:
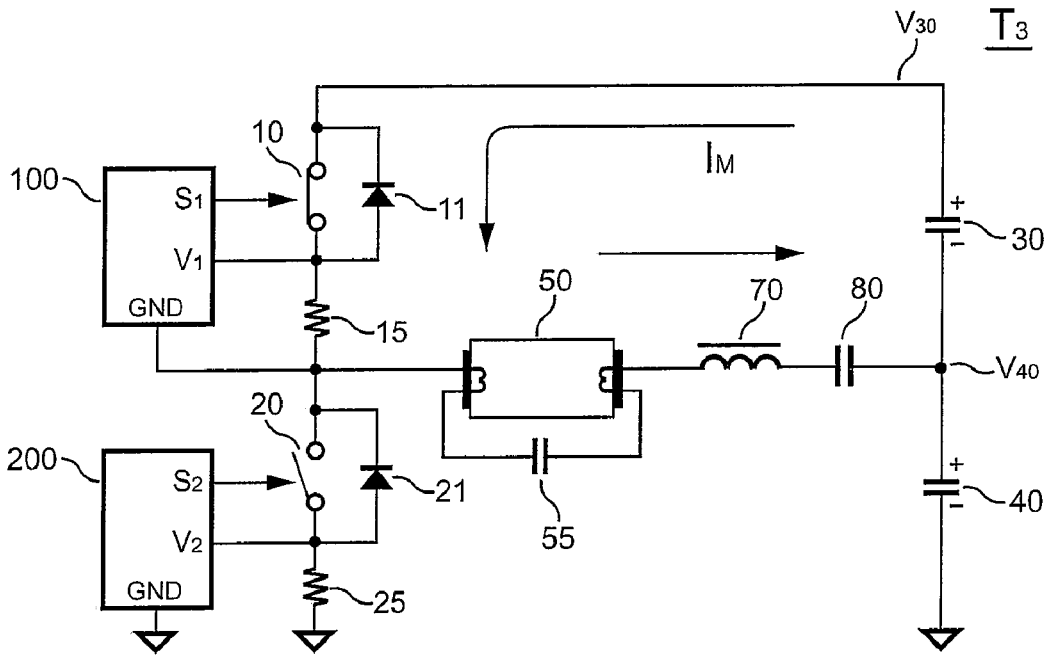
Figure 6:
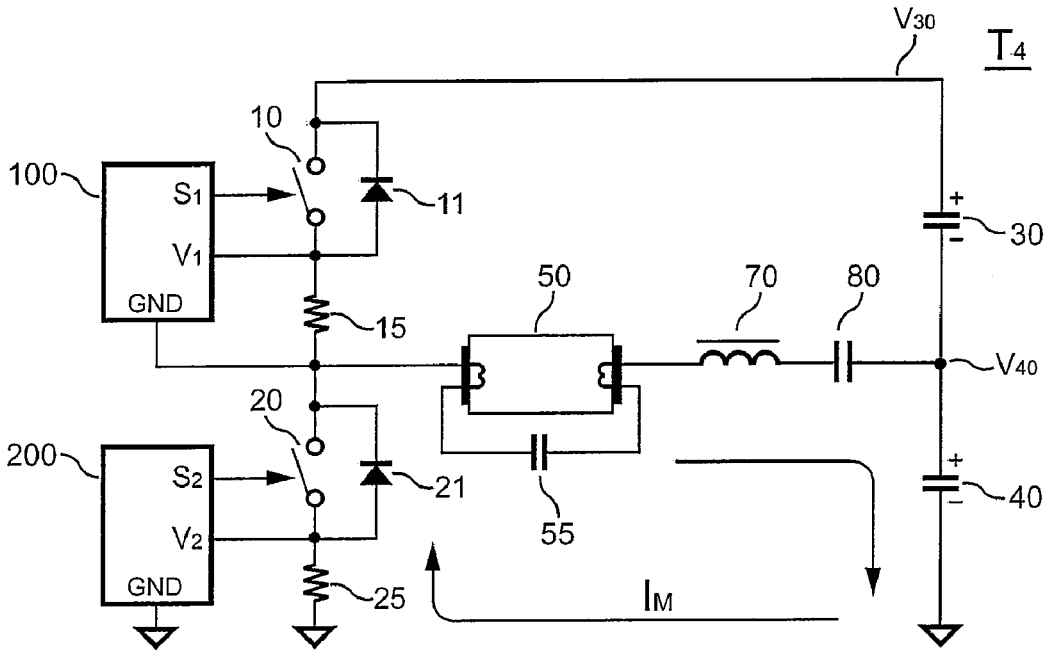

FIG. 2 shows a schematic of a ballast circuit according to an embodiment of the present invention. An inductor 70 and a capacitor 80 are connected in series to form a resonant circuit. The resonant circuit generates a sine wave current to operate the fluorescent lamps, such as the lamp 50. A first circuit comprising a first control circuit 100, a first switch 10, a first diode 11, and a first resistor 15 is coupled to the resonant circuit. A second circuit comprising a second control circuit 200, a second switch 20, a second diode 21, and a second resistor 25 is also coupled to the resonant circuit. The first switch 10 is coupled to the resonant circuit to supply a first voltage $V_{30}$ to the resonant circuit. The first switch 10 is controlled by a first switching signal $S_1$. A second circuit coupled to the resonant circuit comprises a second switch 20 to supply a second voltage $V_{40}$ to the resonant circuit. The second switch 20 is controlled by a second switching signal $S_2$. A first resistor 15 is connected in series with the first switch 10 for generating a first control signal $V_1$ in response to a switching current of the first switch 10. A first diode 11 is parallel connected with the first switch 10. A second resistor 25 is connected in series with the second switch 20 for generating a second control signal $V_2$ in response to a switching current of the second switch 20. A second diode 21 is parallel connected with the second switch 20. The first control circuit 100 generates the first switching signal $S_1$ to turn on/off the first switch 10 in response to the waveform of the first control signal $V_1$. The second control circuit 200 generates the second switching signal $S_2$ for controlling the second switch 20 in response to the waveform of the second control signal $V_2$.

FIG. 3~FIG. 6 respectively shows the operation phases of the ballast circuit according to an embodiment of the present invention. When the second switch 20 is turned on (phase $T_1$), a lamp current $I_M$ flows via the second resistor 25 to generate the second control signal $V_2$. Once the lamp current $I_M$ decreases and the second control signal $V_2$ is lower than a second threshold $V_{T2}$, the second switch 20 is then turned off. After that, a circular current of the resonant circuit turns on the first diode 11. The energy stored in the resonant circuit reversely charges a first capacitor 30 (phase $T_2$). The lamp current $I_M$ flowing via the first resistor 15 generates the first control signal $V_1$. Once the first control signal $V_1$ is lower than a first zero-threshold $V_{Z1}$, the first control circuit 100 enables the first switching signal $S_1$ to turn on the first switch 10. Since the first diode 11 is being conducted at this moment, the first switch 10 is turned on with soft switching (phase $T_3$). The lamp current $I_M$ flows to the resonant circuit from the capacitor 30 after the circular current of the resonant circuit is reversed. When the lamp current $I_M$ decreases and the control signal $V_1$ is lower than a first threshold $V_{T1}$, the first switch 10 is then turned off. Meanwhile, the circular current of the resonant circuit turns on the second diode 21, and the energy of the resonant circuit reversely charge a second capacitor 40 (phase $T_4$). Therefore, the second switch 20 is also turned on with soft switching.

FIG. 7 shows a plurality of waveforms of the operation phases according to the present invention. The first switching signal $S_1$ is enabled once the first control signal $V_1$ is lower than the first zero-threshold $V_{Z1}$. After a quarter resonant period of the resonant circuit, the first switching signal $S_1$ is disabled once the first control signal $V_1$ is lower than the first threshold $V_{T1}$. A resonant frequency $F_R$ of the resonant circuit is given by, $$f_R = \frac{1}{2\pi\sqrt{LC}} \tag{1}$$

where L is the inductance of the inductor 70, and C is the equivalent capacitance of the capacitor 80 and the lamp 50.

The second switching signal $S_2$ is enabled once the second control signal $V_2$ is lower than the second zero-threshold $V_{Z2}$. Also, after the quarter resonant period of the resonant circuit, the second switching signal $S_2$ is disabled once the second control signal $V_2$ is lower than the second threshold $V_{T2}$, in which the magnitude of the first zero-threshold $V_{Z1}$ is equal to that of the second zero-threshold $V_{Z2}$. The magnitude of the first threshold $V_{T1}$ is equal to that of the second zero-threshold $V_{T2}$. Once the switching current of the first switch 10 is equal to the switching current of the second switch 20, the need for the capacitor 80 is eliminated.

A delay time $T_{D1}$ as shown in FIG. 7 is designed for the debounce purpose. The delay time $T_{D1}$ represents a delay from the detection of the first control signal $V_1$ being lower than the first zero-threshold $V_{Z1}$ to the moment that the first switch 10 is turned on. A delay time $T_{D2}$ is also used for the debounce purpose. The delay time $T_{D2}$ represents another delay from the detection of the second control signal $V_2$ being lower than the second zero-threshold $V_{Z2}$ to the moment that the second switch 20 is turned on.

FIG. 8 shows the first control circuit 100 according to a preferred embodiment of the present invention. A first input terminal is coupled to the first resistor 15 for receiving the first control signal $V_1$. A first comparator 130 has a negative input coupled to the first input terminal via a resistor 115. A first current source 110 is connected to the resistor 115 for shifting the level of the first control signal $V_1$. A positive input of the first comparator 130 is supplied with the first zero-threshold $V_{Z1}$. An output of the first comparator 130 is coupled to enable a flip-flop 170 via a first debounce circuit 160. The first debounce circuit 160 determines the delay time $T_{D1}$. The flip-flop 170 outputs the first switching signal $S_1$ to drive the first switch 10. A second comparator 140 has a negative input coupled to the first input terminal via the resistor 115. A positive input of the second comparator 140 is connected to the first input terminal via a first delay circuit formed by a resistor 120 and a capacitor 125. Therefore, the second comparator 140 shall output a logic-high signal when the magnitude of the first control signal $V_1$ is diminished. A third comparator 145 has a negative input coupled to the first input terminal via the resistor 115. A positive input of the third comparator 145 is supplied with the first threshold $V_{T1}$. The output of the second comparator 140 and an output of the third comparator 145 are connected to an NAND gate 150. An output of the NAND gate 150 is coupled to reset the flip-flop 170 via a second debounce circuit 165. The second debounce circuit 165 determines the delay time $T_{D2}$. Therefore, the first switching signal $S_1$ is enabled in response to the output of the first comparator 130. The first switching signal $S_1$ is disabled in response to the outputs of the second comparator 140 and the third comparator 145.

FIG. 9 shows the second control circuit 200 according to a preferred embodiment of the present invention. A second input terminal is coupled to the second resistor 25 for receiving the second control signal $V_2$. A fourth comparator 230 has a negative input coupled to the second input terminal via a resistor 215. A second current source 210 is connected to the resistor 215 for shifting the level of the second control signal $V_2$. A positive input of the comparator 230 is supplied with the second zero-threshold $V_{Z2}$. An output of the fourth comparator 230 is connected to an input of an OR gate 255. Another input of the OR gate 255 is supplied with a reset signal RST for switching on the second switch 20 during the turning on period of the ballast. The output of the OR gate 255 is coupled to enable a flip-flop 270 via a third debounce circuit 260. The third debounce circuit 260 determines the delay time $T_{D1}$. The flip-flop 270 outputs the second switching signal $S_2$ for driving the second switch 20. A fifth comparator 240 has a negative input coupled to the second input terminal via the resistor 215. A positive input of the fifth comparator 240 is connected to the second input terminal via a second delay circuit formed by a resistor 220 and a capacitor 225. Therefore, the fifth comparator 240 outputs a logic-high signal when the magnitude of the second control signal $V_2$ is diminished. A sixth comparator 245 has a negative input coupled to the second input terminal via the resistor 215. A positive input of the sixth comparator 245 is supplied with the second threshold $V_{T2}$. An output of the fifth comparator 240 and an output of the sixth comparator 245 are connected to an NAND gate 250. An output of the NAND gate 250 is coupled to reset the flip-flop 270 via a fourth debounce circuit 265. The fourth debounce circuit 265 determines the delay time $T_{D2}$.

FIG. 10 is an embodiment of the debounce circuits 160, 165, 260, 265 according to the present invention. In this embodiment, a third current source 310 and a capacitor 325 determine a delay time while an output OUT becomes logic-low after an input IN becomes logic-low. A fourth current source 315 and the capacitor 325 determine a delay time while an output OUT becomes logic-high after an input IN becomes logic-high. Therefore, FIG. 9 shows that the second switching signal $S_2$ is enabled in response to the output of the fourth comparator 230 and the reset signal RST. The second switching signal $S_2$ is disabled in response to the outputs of the fifth comparator 240 and the sixth comparator 245.

While the present invention has been particularly shown and described with reference to preferred embodiments thereof, it will be understood by those of ordinary skill in the art that various changes in form and details may be made therein without departing from the spirit and scope of the present invention as defined by the appended claims.

What is claimed is:

1. A ballast circuit, comprising:

a resonant circuit, formed by a series connection of an inductor and a capacitor to operate a lamp;

a first switch, coupled to said resonant circuit for supplying a first voltage to said resonant circuit, wherein said first switch is controlled by a first switching signal;

a second switch, coupled to said resonant circuit for supplying a second voltage to said resonant circuit, wherein said second switch is controlled by a second switching signal;

a first resistor, connected in series with said first switch for generating a first control signal in response to a switching current of said first switch;

a second resistor, connected in series with said second switch for generating a second control signal in response to a switching current of said second switch;

a first control circuit, for generating said first switching signal to control said first switch in response to said first control signal; and a second control circuit, for generating said second switching signal to control said second switch in response to said second control signal.

2. The ballast circuit as claimed in claim 1, wherein said first switching signal is enabled once said first control signal is lower than a first zero-threshold, and after a quarter resonant period of said resonant circuit, said first switching signal is disabled once said first control signal is lower than a first threshold.

3. The ballast circuit as claimed in claim 2, wherein said second switching signal is enabled once said second control signal is lower than a second zero-threshold, and after a quarter resonant period of said resonant circuit, said second switching signal is disabled once said second control signal is lower than a second threshold.

4. The ballast circuit as claimed in claim 3, wherein the magnitude of said first zero-threshold is equal to that of said second zero-threshold, and the magnitude of said first threshold is equal to that of said second threshold.

5. The ballast circuit as claimed in claim 1, wherein said first control circuit comprises:

an first input terminal, coupled to said first resistor;

a first comparator, having an input coupled to said first input terminal, and another input of said first comparator being supplied with a first zero-threshold;

a second comparator, having an input coupled to said first input terminal, and another input of said second comparator being connected to said first input terminal via a first delay circuit; and a third comparator, having an input coupled to said first input terminal, and another input of said third comparator being supplied with a first threshold, wherein said first switching signal is enabled in response to an output of said first comparator, and said first switching signal is disabled in response to the outputs of said second comparator and said third comparator.

6. The ballast circuit as claimed in claim 1, wherein said second control circuit comprises:

a second input terminal, coupled to said second resistor;

a fourth comparator, having an input coupled to said second input terminal, and another input of said fourth comparator being supplied with a second zero-threshold;

a fifth comparator, having an input coupled to said second input terminal, and another input of said fifth comparator being connected to said second input terminal via a second delay circuit; and a sixth comparator, having an input coupled to said second input terminal, and another input of said sixth comparator being supplied with a second threshold, wherein said second switching signal is enabled in response to an output of said fourth comparator, and said second switching signal is disabled in response to the outputs of said fifth comparator and said sixth comparator.

7. The ballast circuit as claimed in claim 5, wherein said first control circuit further comprising:

a first debounce circuit, coupled to enable said first switching signal; and a second debounce circuit, coupled to disable said first switching signal.

8. The ballast circuit as claimed in claim 6, wherein said second control circuit further comprises:

a third debounce circuit, coupled to enable said second switching signal; and a fourth debounce circuit, coupled to disable said second switching signal.

9. A ballast, comprising:

a resonant circuit, formed by a series connection of a capacitor and an inductor to operate a lamp;

a first switch, coupled to switch said resonant circuit, wherein said first switch is controlled by a first switching signal;

a second switch, coupled to switch said resonant circuit, wherein said second switch is controlled by a second switching signal;

a first resistor, connected in series with said first switch for generating a first control signal in response to a switching current of said first switch;

a second resistor, connected in series with said second switch for generating a second control signal in response to a switching current of said second switch;

a first control circuit, coupled to generate said first switching signal to control said first switch in response to said first control signal; and a second control circuit, coupled to generate said second switching signal to control said second switch in response to said second control signal.

10. The ballast as claimed in claim 9, wherein said first switching signal is enabled once said first control signal is lower than a first zero-threshold, and after a quarter resonant period of said resonant circuit, said first switching signal is disabled once said first control signal is lower than a first threshold; wherein said second switching signal is enabled once said second control signal is lower than a second zero-threshold, and after a quarter resonant period of said resonant circuit, said second switching signal is disabled once said second control signal is lower than a second threshold.

11. The ballast as claimed in claim 10, wherein the magnitude of said first zero-threshold is equal to that of said second zero-threshold, and the magnitude of said first threshold is equal to that of said second threshold.

12. The ballast as claimed in claim 9, wherein said first control circuit comprises:

a first input terminal, coupled to said first resistor;

a first comparator, having an input coupled to said first input terminal, and another input of said first comparator being supplied with a first zero-threshold;

a second comparator, having an input coupled to said first input terminal, and another input of said second comparator being connected to said first input terminal via a first delay circuit; and a third comparator, having an input coupled to said first input terminal, and another input of said third comparator being connected to a first threshold, wherein said first switching signal is enabled in response to an output of said first comparator, and said first switching signal is disabled in response to the outputs of said second comparator and said third comparator.

13. The ballast as claimed in claim 9, wherein said second control circuit comprises:

a second input terminal, coupled to said second resistor;

a fourth comparator, having an input coupled to said second input terminal, and another input of said fourth comparator being supplied with a second zero-threshold;

a fifth comparator, having an input coupled to said second input terminal, and another input of said fifth comparator being connected to said second input terminal via a second delay circuit; and a sixth comparator, having an input coupled to said second input terminal, and another input of said sixth comparator being supplied with a second threshold, wherein said second switching signal is enabled in response to an output of said fourth comparator, and said second switching signal is disabled in response to the outputs of said fifth comparator and said sixth comparator.

14. The ballast as claimed in claim 12, wherein said first control circuit further comprises:

a first debounce circuit, coupled to enable said first switching signal; and a second debounce circuit, coupled to disable said first switching signal.

15. The ballast as claimed in claim 13, wherein said second control circuit further comprises:

a third debounce circuit, coupled to enable said second switching signal; and a fourth debounce circuit, coupled to disable said second switching signal.

* * * * *